United States Patent [19]

Ginzburg

[11] 4,444,038

[45] Apr. 24, 1984

[54] METHOD OF MODERNIZING A HOT STRIP MILL

[75] Inventor: Vladimir B. Ginzburg, Pittsburgh, Pa.

[73] Assignee: Tippins Machinery Company, Inc., Pittsburgh, Pa.

[21] Appl. No.: 314,580

[22] Filed: Oct. 26, 1981

Related U.S. Application Data

[63] Continuation-in-part of Ser. No. 306,894, Sep. 29, 1981.

[51] Int. Cl.[3] ..... B21B 1/26

[52] U.S. Cl. ..... 72/234; 72/366

[58] Field of Search ..... 72/16, 199, 202, 226, 72/234, 366

[56] References Cited

U.S. PATENT DOCUMENTS 4,030,326 6/1977 Morooka et al. ..... 72/16

FOREIGN PATENT DOCUMENTS 54-5785 3/1979 Japan ..... 72/234

OTHER PUBLICATIONS

Translation of Japanese 54–5785 previously cited.

*Primary Examiner*—Francis S. Husar
*Assistant Examiner*—Steven B. Katz
*Attorney, Agent, or Firm*—Webb, Burden, Robinson & Webb

[57] ABSTRACT

A method of implementing the modernization of continuous tandem hot strip rolling in existing hot strip mills includes utilizing certain of the roughing stands of the roughing train and installing at least two tandem stands upstream of the finishing train in the area of the holding table so as to provide continuous tandem rolling with the finishing train. A critical transfer bar thickness on the order of 3.8 to 5 inches is necessary for the product going into the initial tandem mill stand to assure optimum results for the modernized mill.

4 Claims, 3 Drawing Figures

METHOD OF MODERNIZING A HOT STRIP MILL

CROSS REFERENCES TO RELATED APPLICATION

This application is a continuation-in-part of my patent application Ser. No. 306,894, filed Sept. 29, 1981 and entitled "Continuous Tandem Hot Strip Mill and Method of Rolling".

FIELD OF THE INVENTION

My invention relates to continuous hot strip mills for reducing slabs to strip thicknesses and, more particularly, to a method of implementing the modernization of continuous tandem hot strip rolling on existing mills to achieve optimum conditions of quality.

DESCRIPTION OF THE PRIOR ART

In my copending application Ser. No. 306,894, filed Sept. 29, 1981, I disclosed a constant mass flow hot strip mill which represents a quantum jump in hot strip mill construction and rolling over the conventional hot strip mill and the existing modernized hot strip mills of today. In that application I disclose a hot strip mill comprised of a plurality of mill stands TM1 through TMX with each of the stands spaced from an adjacent stand by a distance less than the length of the strip between the stands so that the entire hot strip mill rolls in tandem at a constant mass flow. The method of rolling includes selecting a critical slab thickness for introduction into the mill to result in a given minimum temperature differential from head to tail of the product. In effect, I found that for every cycle time there is a critical material thickness entering the continuous tandem mill which provides the acceptable temperature differential from front to tail to achieve uniform metallurgical properties and acceptable rolling conditions. The above mill and rolling procedure provides optimum quality and increased coil weights in terms of PIW. In addition, that mill is very compact, easily controlled and automated to the point of requiring a minimum of labor to operate it.

While it is believed that the above described hot strip mill is the ultimate solution for hot strip mills, there are certain practical limitations when this solution is applied to existing installations. For example, it is generally recognized that profit margins are such in the steel industry that the hot strip mill must operate continually. Therefore, major shutdowns to replace existing hot strip mills with a hot strip mill of the type described in my copending application are costly. At the same time, existing hot strip mills include a finishing train which forms an integral part of my mill. Therefore, there remains a need for a practical way to modernize existing hot strip mills. The present practices of using coil boxes, tunnel furnaces, differential heating, reversing mills with coiler furnaces or FO stands are effective in varying degrees, but they represent only a step toward the performance achieved in the ultimate hot strip mill described in my copending application.

It is recognized that to increase coil weights from 500 PIW to 1000 PIW in existing mills, it is generally necessary to build new furnaces and downcoilers or rebuild old ones to accommodate the larger slabs.

SUMMARY OF THE INVENTION

My invention allows for an existing hot strip mill to be modernized in stages to ultimately arrive at the total constant mass flow hot strip mill of my above referred to copending application. This modernization avoids the necessity of a major shutdown thereby only minimally affecting the short term profit margins for existing hot strip mills as they are so modernized. The long term quality is improved through the initial phase of my modernization.

My invention provides for the utilization of one or more of the roughing stands from the roughing train and the installation of at last two tandem stands upstream of the finishing train in the area of the holding table but spaced from the finishing stands so as to provide continuous tandem rolling with the finishing train under a constant mass flow. A critical transfer bar thickness on the order of 3.8 to 5 inches is selected for introduction into the initial tandem mill to assure acceptable productivity and quality. The initial slab thickness is generally on the order of 7–12 inches, the PIW is generally on the order of 500 and the final strip thickness is generally on the order of 0.080 inch minimum. The slab has a temperature on the order of 1800°–2200° F. and the constant mass flow in the mill is on the order of 200 inches×FPM. Such a construction provides a very effective and workable intermediate step between existing hot strip mills and the ultimate hot strip mill of my copending application.

DESCRIPTION OF THE PREFERRED EMBODIMENTS

Figure 1:
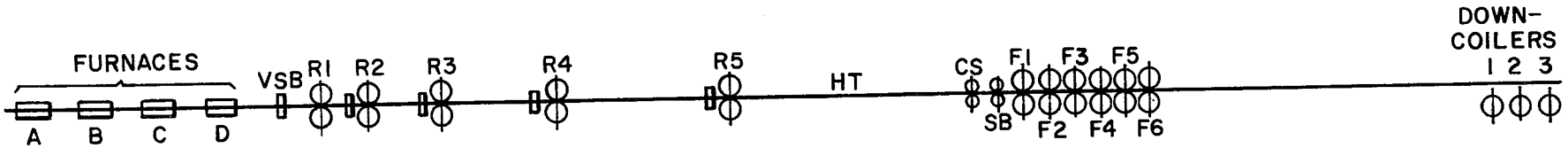
Fig. 1 (PRIOR ART)
FIG. 1 is a schematic showing the general arrangement of a conventional continuous hot strip mill.

The hot strip mill of FIG. 1 is an existing conventional hot strip mill comprised of a roughing train having mill stands R1 through R5 with appropriate vertical edges and scale breakers VSB and a finishing train comprised of tandem mill stands F1 through F6 with appropriate crop shear CS and scale breaker SB. The hot strip mill receives slabs which have been reheated in one of four furnaces A through D located upstream of the roughing train. The roughing train is separated from the finishing train by a holding table HT which normally is in excess of 200 feet in length. A slab is reduced to a transfer bar in the roughing train and then retained on the holding table prior to being fed into the finishing train defined by the mill stands F1 through F6. The transfer bar is rolled continuously and in tandem to strip thicknesses on the finishing train. At the exit end of the last finishing stand F6 there is a long runout table which employs cooling water sprays to cool the strip down from the finishing temperature to the desired temperature prior to being coiled on one of three downcoilers 1 through 3.

Figure 2:
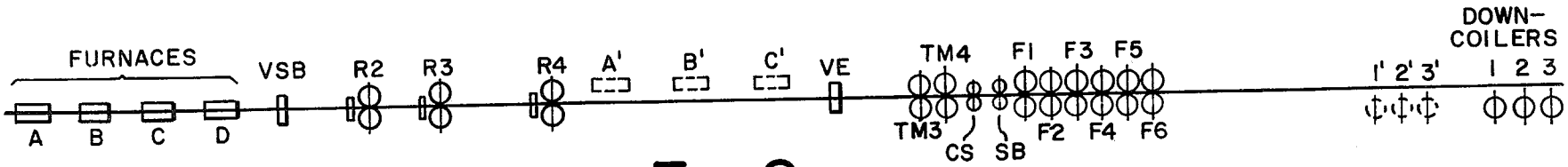
FIG. 2 is a schematic showing the general arrangement of my improved hot strip mill.

My modernization of the conventional hot strip mill of FIG. 1 is illustrated in FIG. 2. The roughing stands R1 and R5 have been removed leaving three roughing stands R2 through R4. However, it may not be necessary to remove any roughing stands where thicker slabs are to be utilized. A pair of roll stands TM3 and TM4 are installed upstream of finishing stand F1 of the finishing train and in close coupled relationship with the finishing train so as to roll in tandem therewith. Specifically, the tandem mill stands TM3 and TM4 are located at the downstream end of what was previously the holding table HT. A vertical edger VE is positioned upstream of the initial tandem mill stand TM3 and is spaced therefrom to accommodate future tandem mill stands TM1 and TM2 (not shown). A transfer bar entering TM3 is rolled continuously and in tandem at a constant mass flow throughout the eight stands TM3 through F6.

While the mill of FIG. 2 is in operation, new furnaces as illustrated at A', B' and C' and new downcoilers shown at 1', 2' and 3' can be built. These furnaces and downcoilers are designed to handle the slabs and coils necessary for the increased coil weights up to 1000 PIW and greater.

The hot strip mill of FIG. 2 may then be further modified into the hot strip mill described in my copending application Ser. No. 306,894. The remaining roughing mill stands R2 through R4 are eliminated and additionally two tandem mills are added upstream of TM3 and TM4. In effect, the hot strip mill of FIG. 2 is an intermediate step to the ultimate hot strip mill, yet one which provides immediate improvement in quality.

This improved quality cam about through the selection of the appropriate transfer bar thickness for feeding into the initial tandem mill stand TM3. Through the selection of the proper transfer bar thickness, I am able to achieve a minimal temperature differential from front to tail of the workpiece being rolled and thus improve the quality of the product and the loading requirements on the particular mill stands. I have used a temperature differential of 30° F. as my standard but the rolling method and mill arrangement results in even less of a temperature differential.

This critical thickness is determined in the same manner described for the critical thickness in my copending application Ser. No. 306,894. The critical thickness is obtainable from the empirical relationship:

$$\Delta T = \left(T_F - 1800 + \frac{1}{n}\right)(1 - e^{-\alpha \cdot n \cdot t}) \quad (1)$$

where $T_F$=front end temperature when entering the tandem mill in °F.; e is the logarithmic base; Δ is the temperature loss rate at 1800° F., °F./sec.; and n=parameter defining the variation of $\alpha$ with temperature, °F.$^{-1}$, $\alpha$ in turn is:

$$\alpha = \frac{2.9}{h^{1.05}} \quad (2)$$

and $$n = \frac{0.0025}{1 + 0.1h} \quad (3)$$

Figure 3:
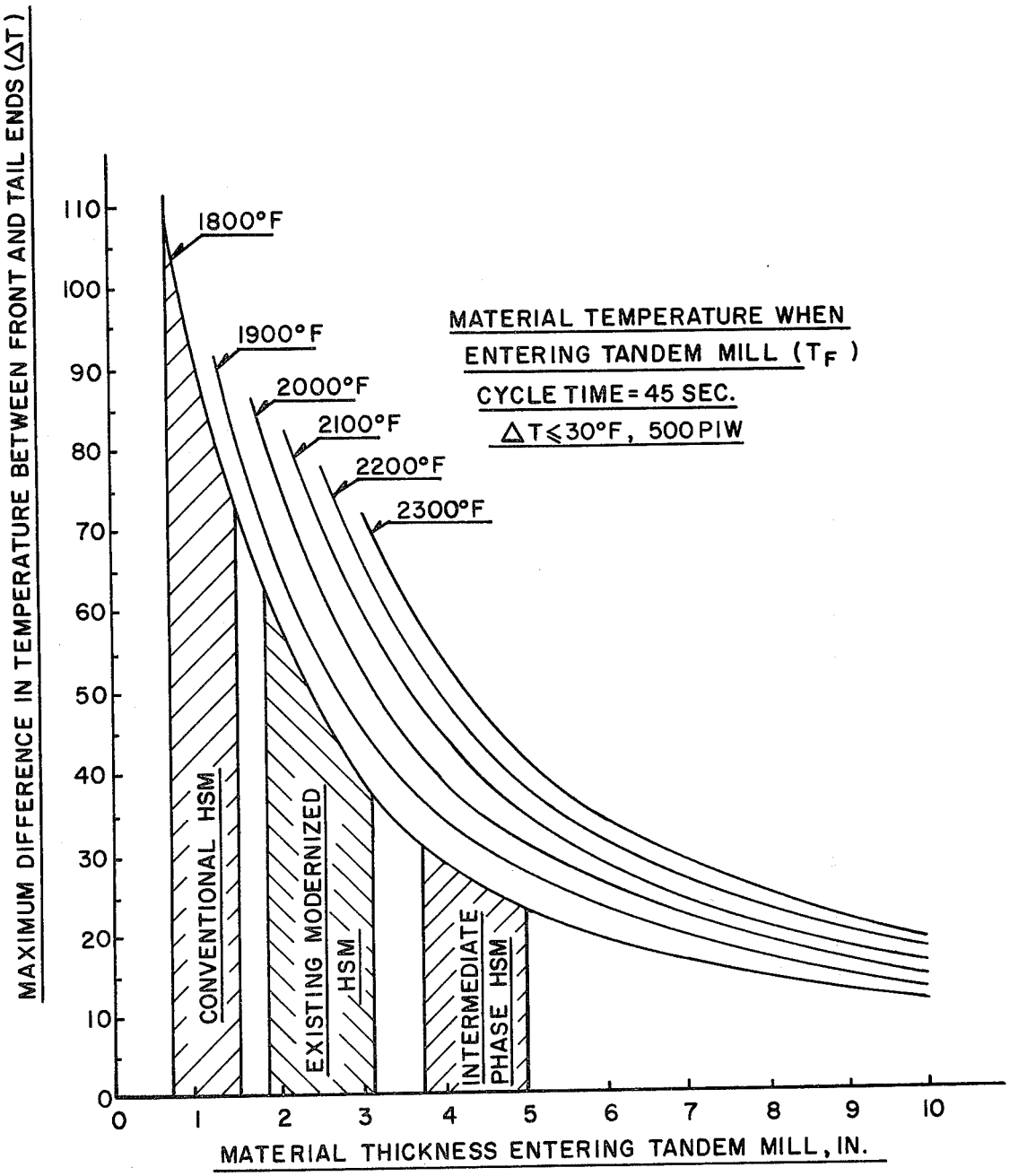
FIG. 3 is a graph showing the effect of material thickness entering the tandem mill in relation to the difference in temperature between front and tail ends of the slab.

Equations 1 through 3 are plotted in FIG. 3 for a cycle time of 45 seconds. It can be seen from the curves of FIG. 3 that while a critical slab thickness on the order of 3.8 to 5 inches does not give the quantum jump in results as compared to the Tippins constant mass flow hot strip mill covered by my copending application, it does represent a substantial improvement in front to tail temperature differential as compared to the conventional hot strip mill or to a modernized hot strip mill, i.e., one which has been modernized through the installation of a tunnel furnace over the holding table or coil boxes of a reversing mill with coiling furnaces as a means of acquiring acceptable front to tail temperature differentials.

The following Table 1 is a rolling schedule and temperature profile for the rolling of a slab into strip thickness on my continuous tandem hot strip mill of FIG. 2 where a critical thickness of 5 inches has been selected for the transfer bar going into a first tandem mill stand TM3. The slab of low carbon steel has a thickness of 9 inches, a width of 39.5 inches and a length of 16.4 feet. The temperature out of the furnace is 1900° F. and the final strip thickness is 0.11 inch.

TABLE 1

| | | | Rolling Schedule and Temperatures | | | | | | |
|---|---|---|---|---|---|---|---|---|---|
| | | | | Temperature, °F. | | | | | |
| | Gauge | Speed | Mass Flow | Entry | | Exit | | Rated | Percent |
| Mill | Inches | FPM | Inch × FPM | Front | Tail | Front | Tail | HP | Reduction |
| Furnace | 9.0 | | | 1900 | 1900 | 1900 | 1900 | | |
| R2 | 7.5 | 243.0 | 1822 | 1887 | 1885 | 1886 | 1884 | 3500 | 16.7 |
| R3 | 6.0 | 340.0 | 2040 | 1880 | 1878 | 1881 | 1879 | 4500 | 20 |
| R4 | 5.0 | 474.0 | 2370 | 1873 | 1871 | 1873 | 1872 | 4500 | 16.7 |
| TM3 | 3.0 | 64.8 | 194.3 | 1852 | 1827 | 1851 | 1827 | 4000 | 40.0 |
| TM4 | 1.250 | 155.4 | 194.3 | 1835 | 1812 | 1809 | 1787 | 8000 | 58.3 |
| F1 | 0.780 | 249.0 | 194.3 | 1773 | 1751 | 1740 | 1719 | 4000 | 37.6 |
| F2 | 0.394 | 493.0 | 194.3 | 1726 | 1705 | 1735 | 1715 | 7000 | 49.5 |
| F3 | 0.274 | 708.9 | 194.3 | 1720 | 1701 | 1722 | 1703 | 4000 | 30.5 |
| F4 | 0.168 | 1156.3 | 194.3 | 1707 | 1689 | 1713 | 1695 | 7000 | 38.7 |
| F5 | 0.130 | 1494.2 | 194.3 | 1698 | 1681 | 1697 | 1681 | 4000 | 22.6 |
| F6 | 0.111 | 1750.0 | 194.3 | 1682 | 1666 | 1677 | 1662 | 3500 | 14.6 |

It can be seen that providing constant mass flow and exiting F6 at temperatures on the order of 1662 to 1677 requires an entrance speed into the initial tandem mill of 38.9 feet per minute. This temperature differential has been obtained without the benefit of any zoom or auxiliary equipment or supplemental heating. A simple 5 to 10 percent zoom will reduce the temperature differential even more.

It can therefore be seen that I have provided a way to modernize a mill to achieve on the one hand improved quality and mill loading as compared to existing mills and on the other hand to provide an arrangement which is easily further converted into the ultimate hot strip mill.

I claim:

1. A method of rolling hot slabs having a thickness on the order of 7–12 inches into strip on the order of 500 PIW on a hot strip mill includng a roughing train, a finishing train having a plurality of mill stands F1 though FX and a pair of tandem mill stands TM3 and TM4 positioned upstream F1 and spaced for continuous tandem rolling with the finishing train comprising:

A. feeding to the rolling mill a slab having a temperature on the order of 1800 to 2200° F.;

B. reducing said slab in a roughing train to a transfer bar thickness of 3.8 to 5 inches; and C. reducing said transfer bar to strip having a minimum thickness on the order of 0.080 by passing it continuously through said pair of tandem mill stands and the finishing train while maintaining a constant mass flow on each stand.

2. The method of claim 1 wherein the final strip thickness is 0.011 inch and the constant mass flow is on the order of 200 inches×FPM.

3. The method of claim 2 wherein the finishing train includes finishing strands F1 through F6, the slab thickness is 9 inches, the transfer bar is 5 inches and the transfer bar is reduced in accordance with the following rolling schedule:

| | Exit Gauge (Ins.) | Mill Speed (FPM) |
|---|---|---|
| TM3 | 3 | 64.8 |
| TM4 | 1.25 | 155.4 |
| F1 | 0.78 | 249.0 |
| F2 | 0.39 | 493.0 |
| F3 | 0.27 | 708.9 |
| F4 | 0.16 | 1156.3 |

-continued

| | Exit Gauge (Ins.) | Mill Speed (FPM) |
|---|---|---|
| F5 | 0.13 | 1494.2 |
| F6 | 0.11 | 1750.0 |

4. A method of increasing the productivity and improving the quality of strip produced on a hot strip mill including a roughing train formed of a plurality of roughing stands for converting a slab to a transfer bar, a finishing train formed of a plurality of finishing stands for converting the transfer bar to a hot rolled strip and a holding table positioned between the roughing train and the finishing train comprising installing at least two tandem stands upstream of the finishing train in the area of the holding table and spaced from the finishing train a distance less than the length of a workpiece rolled out of said tandem stands so as to provide continuous tandem rolling with the finishing train and rolling a slab to a critical transfer bar thickness (h) in the roughing train, said critical bar thickness entering the tandem mills being determined from the empirical relationship: $\Delta T=(T_F-1800+1/n)(1-e^{-\alpha.n.t})$ where $\Delta T$ represents the acceptable front to tail strip temperature differential, $T_F$ is the front end temperature of the slab entering TM1, $\alpha$ is the temperature loss rate at 1800° F. in °F./sec., n is a parameter defining the variation of $\alpha$ with temperature, $°F^{-1}$ and t is the time interval between the moment when the slab front enters and the moment when the slab tail enters the tandem mill stands, wherein n and $\alpha$ are functions of h and thickness (h) is obtained from the plot of FIG. 3.

* * * * *

UNITED STATES PATENT AND TRADEMARK OFFICE

CERTIFICATE OF CORRECTION

PATENT NO. : 4,444,038

DATED : April 24, 1984

INVENTOR(S) : Vladimir B. Ginzburg

It is certified that error appears in the above-identified patent and that said Letters Patent is hereby corrected as shown below:

Column 2 Line 10 "last" should read --least--.

Column 3 Line 26 "cam" should read --came--.

Claim 1 - Column 5 Line 2 "though" should read --through--.

Claim 1 - Column 5 Line 3 After "upstream" insert --of--.

Claim 3 - Column 5 Line 21 "strands" should read --stands--.

Signed and Sealed this

*Eleventh* Day of *September 1984*

[SEAL]

*Attest:*

GERALD J. MOSSINGHOFF

*Attesting Officer*

*Commissioner of Patents and Trademarks*